United States Patent [19]

Kallman

[11] 4,051,554

[45] Oct. 4, 1977

[54] ACCESSORY HOLDER FOR USE ON ARTICLE OF CLOTHING

[76] Inventor: Robert A. Kallman, 2030 Haring St., Brooklyn, N.Y. 11229

[21] Appl. No.: 690,262

[22] Filed: May 26, 1976

[51] Int. Cl.[2] ..... A41D 1/00

[52] U.S. Cl. ..... 2/94; 224/5 K

[58] Field of Search ..... 2/94, 249, 250, 268, 2/338, 246; 224/5 K, 5 P, 5 H, 5 R, 5 V

[56] References Cited

U.S. PATENT DOCUMENTS

| | | | |
|---|---|---|---|
| 3,543,977 | 12/1970 | Lockridge | 224/5 |
| 3,751,727 | 8/1973 | Shepard et al. | 2/2.1 A |
| 3,911,500 | 10/1975 | Naumouski | 2/118 |

*Primary Examiner*—Werner H. Schroeder
*Assistant Examiner*—Doris L. Troutman
*Attorney, Agent, or Firm*—Darby & Darby

[57] ABSTRACT

An accessory holder, for use on an article of clothing such as ski jacket or the like, comprising a flap having one end fixed to one attachment point on the article of clothing and adapted to fit around the accessory to be held, such as a pair of ski goggles. The other end of the flap is selectively fastened between another point of attachment on the article of clothing to hold the accessory, and still a further point of attachment where it is stored.

7 Claims, 4 Drawing Figures

ACCESSORY HOLDER FOR USE ON ARTICLE OF CLOTHING

Many situations exist where a person engaged in a sports activity, for example, skiing, motorcycling or scuba diving, in which is desired to carry certain accessories, for example, a pair of ski goggles, a pair of gloves, mask, etc., while leaving the hands free. For example, in the case of ski goggles, when the skier is not using the goggles, he suspends them from around his neck by a strap. The same is true with the mask of a scuba diver. While the accessory can be carried this way when not in use, it is inconvenient and uncomfortable. Further, the accessory can be in the way of the user and also possibly be damaged.

The present invention relates to a novel arrangement for holding and carrying accessories of the foregoing type in a convenient way while leaving the hands of the user completely free. In the preferred embodiment of the invention, the accessory holding arrangement comprises a flap having one end fixed to one point on an article of clothing, for example, a ski jacket, wet suit, etc. The other end of the flap has fastening means which is adapted to be fastened between two alternative points on the clothing article. One of these points is an out-of-use position for the flap where it is stored and the second is a point of fixed, or semi-fixed, attachment such that the accessory to be held can be placed under the flap and the second end of the flap fastened to the second attachment point. In this position of the flap the accessory is securely held.

In the preferred embodiment of the invention, the fixed point of attachment for the first end of the flap is accomplished by sewing this end to the article of clothing. The two alternative points of attachment are provided by having one part of a piece of a fabric type fastener (e.g. VELCRO), such as the hook piece, on the second end of the flap. Two further pieces of the fabric fastener, such as the loop pieces, are fastened to the article of clothing at spaced points. The first is fastened at a point where the flap can be stored and the second is fastened at a point wherein the flap is attached in a manner to hold the accessory.

In the preferred embodiment of the invention, the fixed point of attachment for the first end of the flap is adjacent the shoulder of the jacket and the two alternative points of attachment for the other end of the flap are respectively on the neck and the arm.

It is therefore an object of the invention to provide an accessory holder to be used on an article of clothing.

A further object is to provide a holder for accessory items which is fixed to an article of clothing so that the user can carry one or more accessories and still have his hands free.

An additional object is to provide a holder for accessories for use on an article of clothing in which the holder can be stored out of the way when not in use.

Yet another object is to provide an accessory holder for use on an article of clothing which comprises a flap having one end fixedly secured to the article and a second end which can be fastened at one or the other of two alternative points, the first point being one of storage for the flap and the second being one where the accessory is held.

Other objects and advantages of the present invention will become more apparent upon reference to the following specification and annexed drawings, in which.

Figure 1:
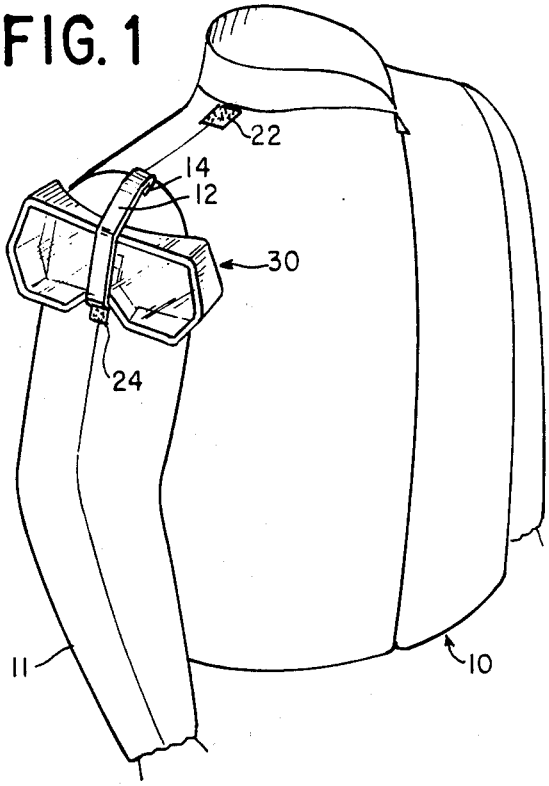
FIG. 1 is a diagrammatic view showing the accessory holder on an article of clothing in a use position.

Referring to the drawings, the article of clothing on which the accessory holder is to be used is shown generally as a jacket 10. This can be, for example, a ski jacket, wet suit, sweater, windbreaker, jump suit, coverall, motorcycle jacket, etc.

Figure 2:
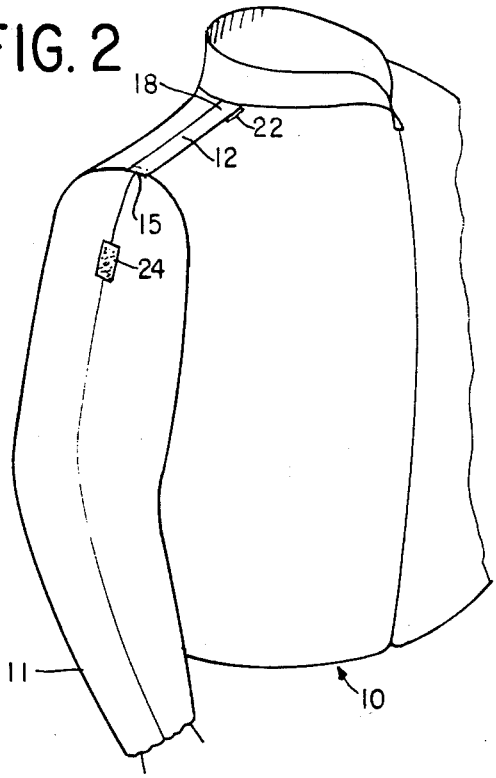
FIG. 2 is a view similar to the one in which the accessory holder is in a storage position.
Figure 4:
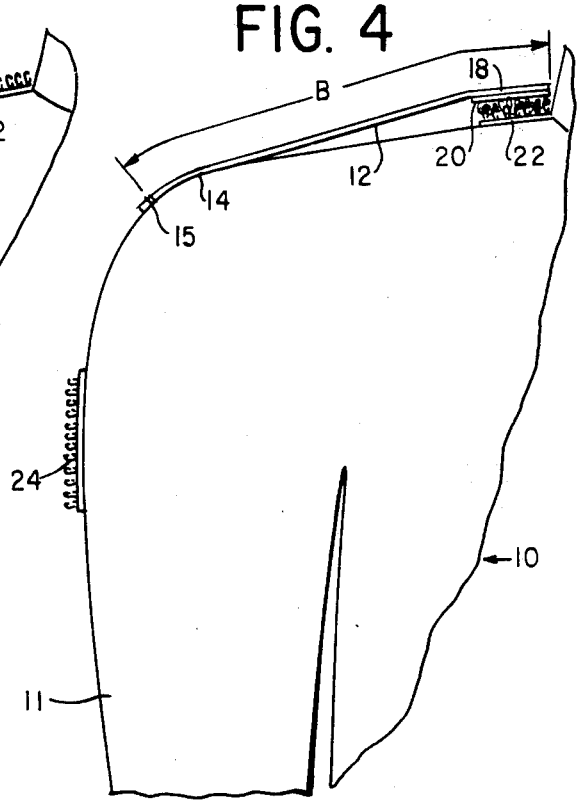
FIG. 4 is a side view of FIG. 2.

The accessory holder includes a flap 12 of a suitable strong material, for example, fabric, plastic, or other similar material. It can be of an inelastic or of an elastic material. Preferably, flap 12 is of a color which is coordinated, i.e. matching or contrasting, with the color of the clothing article 10. Flap 12 has one end 14 fixedly attached to the article of clothing. The fixed point of attachment is shown illustratively at the shoulder seams. The fixed point of attachment also can be at other places, for example, slightly below or above the shoulder seam. Of course, the point of attachment can be varied as desired. That is, it also could be at a midpoint on the arm so that the flap would at all times be on the arm. As shown in FIGS. 2 and 4 the end of the flap is sewn at 15 to the arm of the clothing article. The attachment of the flap end 14 to the sleeve 11 can be by any suitable means, for example, heat-sealing, adhesive, etc. The exact manner of attachment depends upon the various materials used for the article of clothing and the flap.

The second end 18 of flap 12 has a fastener 20 thereon which permits it to be alternately attached between two different locations on the article of clothing. As shown, the fastener 20 is a piece of one part of a fabric-type fastener 20, for example, the hook part of a piece of VELCRO type material.

Two alternative fastening points are provided for the second end 18 of flap 12. In the preferred embodiment of the invention, these are also fabric-type fasteners, here the loop parts of VELCRO material. As shown in the drawings, the first of the two alternative fastening points, is a piece of the fabric fastener material 22 located adjacent the neck of the clothing article 10. The second point is an elongated strip of material 24 which extends substantially vertically along a part of the length of the arm 11 of the clothing article 10. Each of the pieces of the fabric fastener 20, 22 and 24 is attached by any suitable means, for example, sewing, adhesive, heat sealing, etc.

The accessory holder is used in the following manner. As shown in FIGS. 2 and 4, when the holder is not in use, the flap 12 has its second end 18 fastened to the first point of attachment. That is, fastener 20 on the second end of the flap is attached to the first point fastener 22 on the shoulder. When in this position, flap 12 is totally out of the way of the person wearing the clothing and it presents little or no wind resistance.

Figure 3:
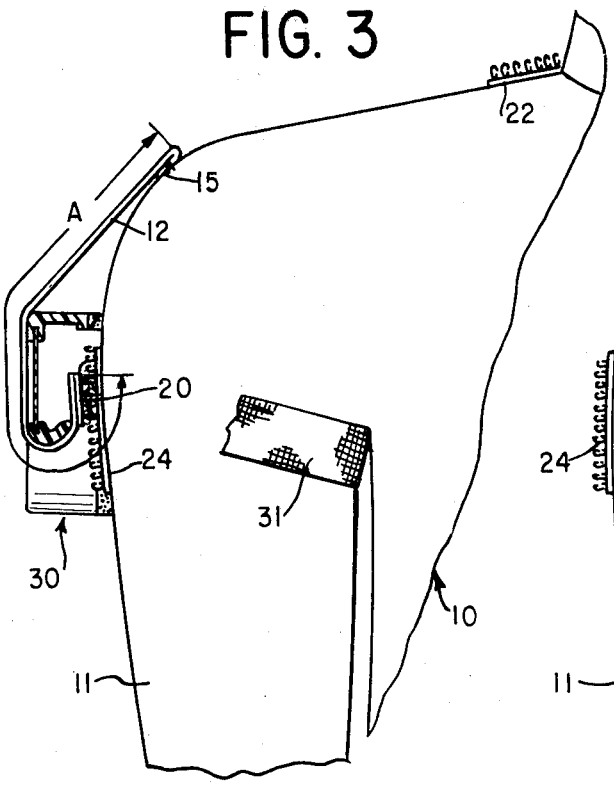
FIG. 3 is side view of FIG. 1 taken partly in cross-section.

When it is desired to hold an accessory, the fastener 20 on the second end 18 of the flap is removed from the shoulder fastener 22. The flap is then placed around the accessory to be held, here shown as a pair of ski goggles 30. The end 18 is then turned under so that the fastener 20 can be attached to the fastener 24 on the sleeve. Since the fastener 24 is elongated, the effective length of flap 12 can be changed to hold the accessory tightly and to accommodate different size articles. That is, a point of attachment can be made for the second end of the flap anywhere along the length of the fastener 24.

Where the flap 12 is made of an elastic material, an additional advantage is obtained in that it can be stretched when in the different positions. Thus, as shown in FIG. 4, flap 12 can be stretched to length B so that it will not flutter and offer little or no wind resistance. Length A in the use position shown in FIG. 3, can be different from length B.

The width of flap 12 also can be selected or desired. In the case of holding a pair of goggles, the flap bends around the nose bridge. This aids in more securely holding the goggles to the arm. Where the flap is of elastic material, this further increases the holding power.

It should be understood, of course, that other types of accessories can be held. For example, in the case of a scuba diver, mask, goggles, flippers, etc. In all cases, the accessory is securely held and the hands of the person are left free. Also, the accessory is stored out of the way.

Other types of fasteners also can be used in place of the fabric type. For example, snaps, buttons, hooks, etc. When these are used, the flaps also can be either of inelastic or elastic material. To vary the effective length of the flap in the use position, there can be a series of buttons or snaps on the arm.

What is claimed is:

1. An accessory holder for an article of clothing for the upper body portion of the type including a shoulder and an arm portion comprising a flap member, one end of said flap member adpated to be fixedly secured at a point on said article, and cooperating means on said flap and for said article for selectively attaching the other end of said flap to one of two points on said article, the first of said two points being a storage position for the flap on the shoulder of the article and the second of said points being on the arm of said article with the accessory to be held by the said other end of the flap passing around the accessory and being attached to the second point.

2. An accessory holder as in claim 1 wherein said flap member is inelastic.

3. An accessory holder as in claim 1 wherein said flap member is of elastic material.

4. An accessory holder as in claim 1 wherein said means for providing the second point of attachment for the second end of the flap member comprises means for attaching the second end at a plurality of spaced points.

5. An accessory holder as in claim 1 wherein said means for attaching the second end of the flap member comprises fabric type fastening means.

6. An accessory holder as in claim 6 wherein said means for attaching the second end of said flap member at said second point comprises an elongated fabric fastener to permit the effective length of the flap member to be adjusted.

7. An accessory holder as in claim 1 in combination with said article of clothing further comprising means for fixedly securing said one end of said flap to said article, and means for securing the cooperating means to said first and second points on said article.

* * * * *